US005876009A

United States Patent [19]

Simoncioni, Jr.

[11] Patent Number: 5,876,009

[45] Date of Patent: Mar. 2, 1999

[54] PORTABLE CLOTHES HANGER HOLDER

[76] Inventor: Otello M. Simoncioni, Jr., 105 Barnwood Dr., Pearl River, La. 70452

[21] Appl. No.: 888,261

[22] Filed: Jul. 3, 1997

[51] Int. Cl.[6] ..... B42F 13/00

[52] U.S. Cl. ..... 248/339; 248/301; 211/88.01

[58] Field of Search ..... 248/339, 301, 248/303, 304; 211/87.01, 88.01, 106.01; 232/19, 33

[56] References Cited

U.S. PATENT DOCUMENTS

| | | | |
|---|---|---|---|
| D. 23,038 | 2/1894 | Wagandt | 404/18 |
| 1,018,913 | 2/1912 | Keagy et al. | 232/19 |
| 1,295,624 | 2/1919 | Smith | 232/19 |
| 1,861,220 | 5/1932 | Marquis | 211/87.01 |
| 1,899,509 | 2/1933 | Lapin | 211/88.01 |
| 1,974,213 | 9/1934 | Gilbert | 211/88.01 |
| 2,194,226 | 3/1940 | Holdren | 232/19 |
| 2,636,633 | 4/1953 | Carlson | 220/23.4 |
| 3,002,666 | 10/1961 | Silverman | 224/42.45 |
| 3,536,287 | 10/1970 | Kramer | 248/301 |
| 5,072,551 | 12/1991 | Manoogian, Jr. | 52/12 |
| 5,624,095 | 4/1997 | Zissu | 248/231.81 |
| 5,662,299 | 9/1997 | Mejia | 248/301 |

*Primary Examiner*—Leslie A. Braun
*Assistant Examiner*—Kimberly Wood

[57] ABSTRACT

A new Portable Clothes Hanger Holder for providing a device from which clothes hangers may be suspended. The inventive device includes a unitary member including a trough-shaped portion and a clip portion extending from the trough-shaped portion. In use, the trough-shaped portion is adapted for receiving the hook of a clothes hanger and the clip portion is adapted for removably securing the unitary member to a horizontal door frame molding.

11 Claims, 2 Drawing Sheets

PORTABLE CLOTHES HANGER HOLDER

BACKGROUND OF THE INVENTION

1. Field of the Invention

The present invention relates to clothes hanging devices and more particularly pertains to a new Portable Clothes Hanger Holder for providing a device from which clothes hangers may be suspended.

2. Description of the Prior Art

The use of clothes hanging devices is known in the prior art. More specifically, clothes hanging devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art clothes hanging devices include U.S. Pat. No. 4,872,568; U.S. Pat. No. 5,433,355; U.S. Pat. No. D267,455; U.S. Pat. No. 5,405,026; U.S. Pat. No. 5,333,743; and U.S. Pat. No. 4,858,867.

While these devices fulfill their respective, particular objectives and requirements, the aforementioned patents do not disclose a new Portable Clothes Hanger Holder. The inventive device includes a unitary member including a trough-shaped portion and a clip portion extending from the trough-shaped portion. In use, the trough-shaped portion is adapted for receiving the hook of a clothes hanger and the clip portion is adapted for removably securing the unitary member to a horizontal door frame molding.

In these respects, the Portable Clothes Hanger Holder according to the present invention substantially departs from the conventional concepts and designs of the prior art, and in so doing provides an apparatus primarily developed for the purpose of providing a device from which clothes hangers may be suspended.

SUMMARY OF THE INVENTION

In view of the foregoing disadvantages inherent in the known types of clothes hanging devices now present in the prior art, the present invention provides a new Portable Clothes Hanger Holder construction wherein the same can be utilized for providing a device from which clothes hangers may be suspended.

The general purpose of the present invention, which will be described subsequently in greater detail, is to provide a new Portable Clothes Hanger Holder apparatus and method which has many of the advantages of the clothes hanging devices mentioned heretofore and many novel features that result in a new Portable Clothes Hanger Holder which is not anticipated, rendered obvious, suggested, or even implied by any of the prior art clothes hanging devices, either alone or in any combination thereof.

To attain this, the present invention generally comprises a unitary member including a trough-shaped portion and a clip portion extending from the trough-shaped portion. In use, the trough-shaped portion is adapted for receiving the hook of a clothes hanger and the clip portion is adapted for removably securing the unitary member to a horizontal door frame molding.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Portable Clothes Hanger Holder apparatus and method which has many of the advantages of the clothes hanging devices mentioned heretofore and many novel features that result in a new Portable Clothes Hanger Holder which is not anticipated, rendered obvious, suggested, or even implied by any of the prior art clothes hanging devices, either alone or in any combination thereof.

It is another object of the present invention to provide a new Portable Clothes Hanger Holder which may be easily and efficiently manufactured and marketed.

It is a further object of the present invention to provide a new Portable Clothes Hanger Holder which is of a durable and reliable construction.

An even further object of the present invention is to provide a new Portable Clothes Hanger Holder which is susceptible of a low cost of manufacture with regard to both materials and labor, and which accordingly is then susceptible of low prices of sale to the consuming public, thereby making such Portable Clothes Hanger Holder economically available to the buying public.

Still yet another object of the present invention is to provide a new Portable Clothes Hanger Holder which provides in the apparatuses and methods of the prior art some of the advantages thereof, while simultaneously overcoming some of the disadvantages normally associated therewith.

Still another object of the present invention is to provide a new Portable Clothes Hanger Holder for providing a device from which clothes hangers may be suspended.

Yet another object of the present invention is to provide a new Portable Clothes Hanger Holder which includes a unitary member including a trough-shaped portion and a clip portion extending from the trough-shaped portion. In use, the trough-shaped portion is adapted for receiving the hook of a clothes hanger and the clip portion is adapted for removably securing the unitary member to a horizontal door frame molding.

Still yet another object of the present invention is to provide a new Portable Clothes Hanger Holder that provides an alternative to the common practice of hanging clothes hangers from door knobs and door frame moldings. Hanging clothes hangers from door frame moldings can easily scratch and mar the surface of the door frame molding. Thus, the present invention allows a person to continue to hang clothes hangers from the door frame molding while protecting the door frame molding from scratches.

Even still another object of the present invention is to provide a new Portable Clothes Hanger Holder that would accommodate practically any style and shape of hanger including metal, heavy-gauge plastic, ball tipped, and wire strand hangers.

Even still another object of the present invention is to provide a new Portable Clothes Hanger Holder that could be easily removed when not in use for convenient storage and transport thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
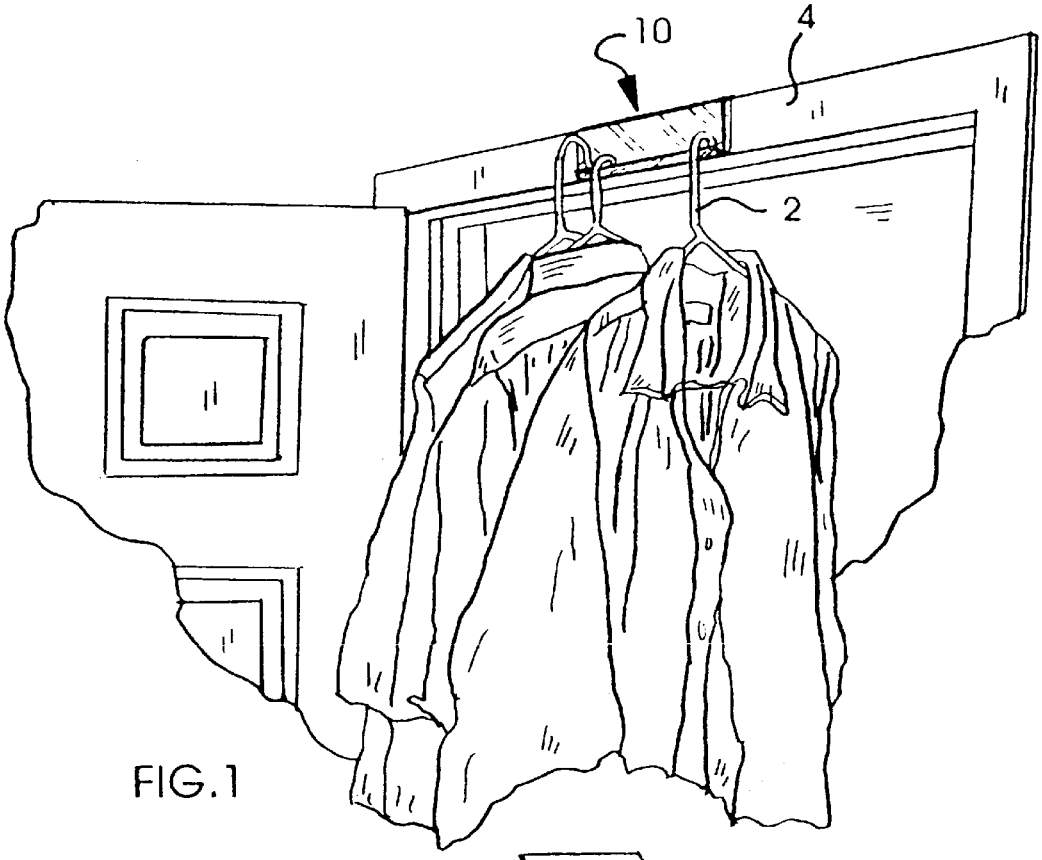
FIG. 1 is an illustration of a new Portable Clothes Hanger Holder in use according to the present invention.
Figure 2:
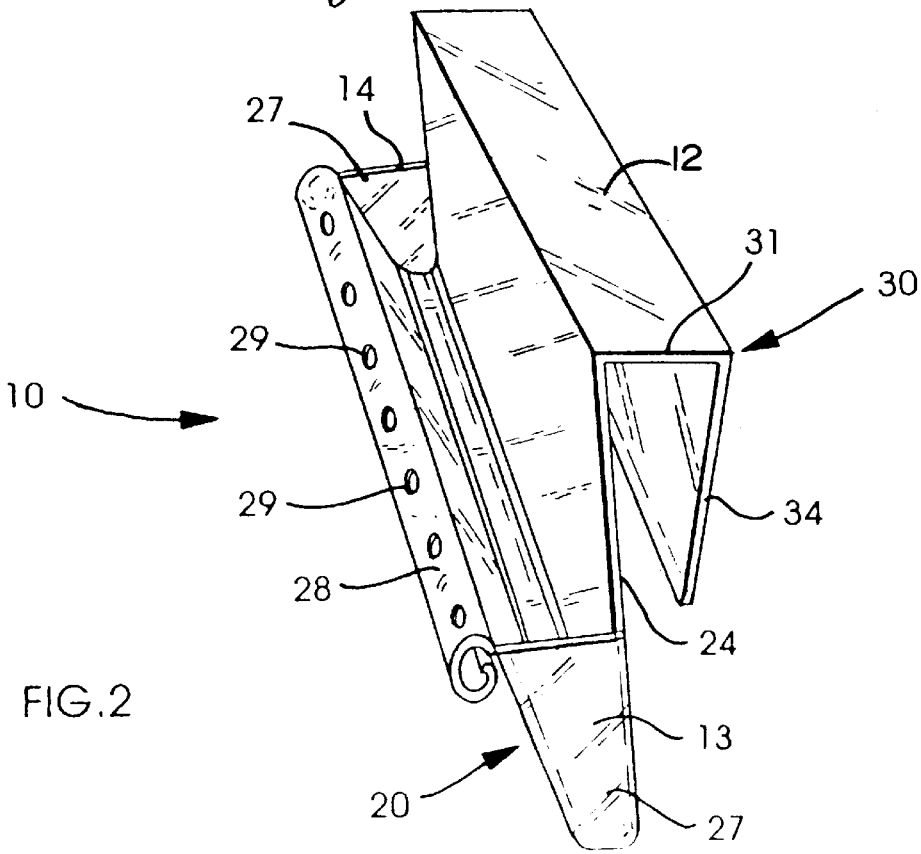
FIG. 2 is an isometric illustration of the present invention.
Figure 3:
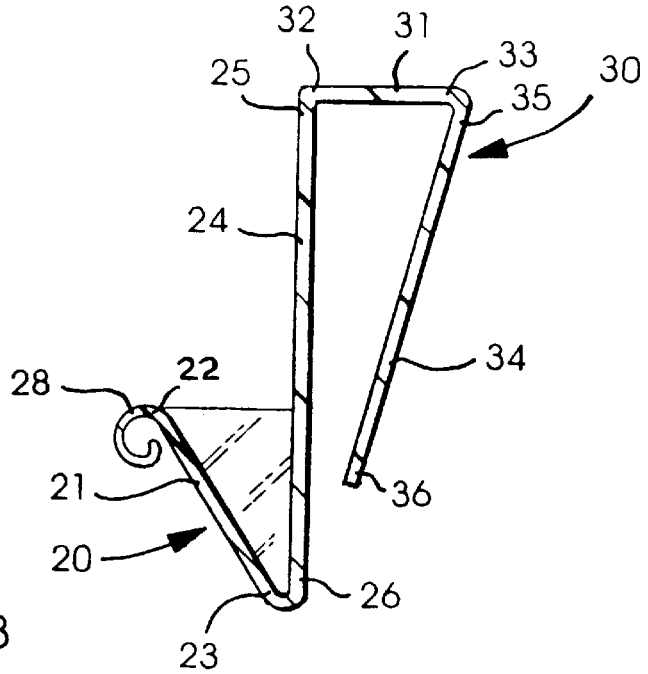
FIG. 3 is a cross sectional view of the present invention.
Figure 4:
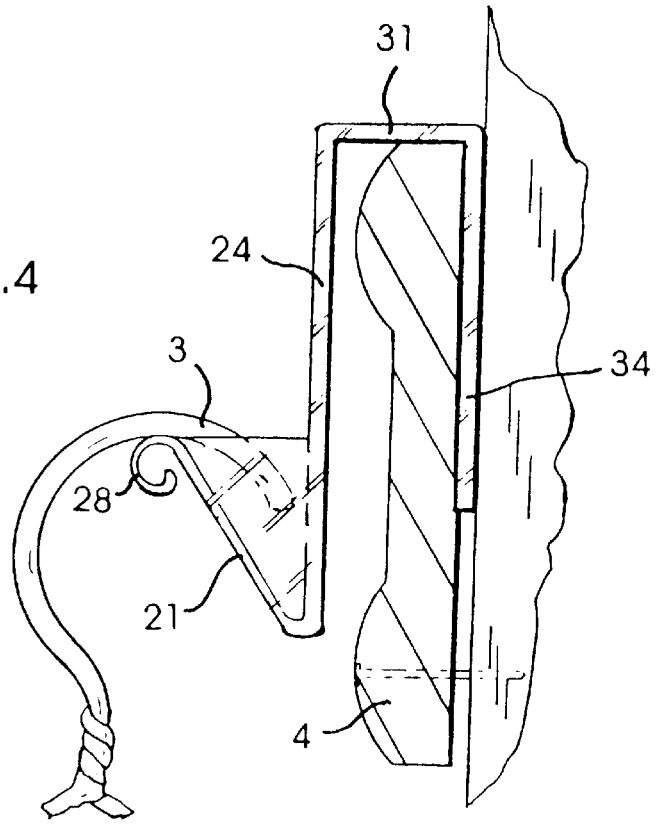
FIG. 4 is a cross sectional view of the present invention installed on a door frame molding.

With reference now to the drawings, and in particular to FIGS. 1 through 4 thereof, a new Portable Clothes Hanger Holder embodying the principles and concepts of the present invention and generally designated by the reference numeral 10 will be described.

As best illustrated in FIGS. 1 through 4, the Portable Clothes Hanger Holder 10 comprises a unitary member 12 including a trough-shaped portion 20 and a clip portion 30 extending from the trough-shaped portion 20. In use, the trough-shaped portion 20 is adapted for receiving the hook 3 of a clothes hanger 2 and the clip portion 30 is adapted for removably securing the unitary member 12 to a horizontal door frame molding 4.

The unitary member 12 has a first end 13 and a second end 14. It is contemplated that the Portable Clothes Hanger Holder 10 be available in various lengths. As such, the unitary member 12 could be about 8 inches long (for travel use) to about 28 inches long (for use along the top of a standard interior door). In addition, the unitary member 12 is preferably formed of clear transparent plastic material so as not to detract from the decorative appearance of the door frame molding 4.

The trough-shaped portion 20 of the unitary member 12 includes a front wall 21 and a rear wall 24 integrally joined to and diverging from the front wall 21. The front wall 21 has a top edge 22 and a bottom edge 23, and the rear wall 24 has an uppermost edge 25 and a lowermost edge 26. Accordingly, the bottom edge 23 of the front wall 21 is integrally joined to the lowermost edge 26 of the rear wall 24. The rear wall 24 is generally vertically oriented and the front wall 21 diverges from the rear wall 24 towards the top edge 22 thereof. In a preferred embodiment, the uppermost edge 25 of the rear wall 24 extends above the top edge 22 of the front wall 21. A pair of side walls 27 interconnect the front wall 21 and the rear wall 24 at the first and second ends 13 and 14, respectively, of the unitary member 12.

In a preferred embodiment, a lip 28 is provided along the top edge 22 of the front wall 21. The lip 28 has a plurality of spaced holes 29 therein extending substantially from the first end 13 of the unitary member 12 to the second end 14. Each of the holes 29 in the lip 28 are adapted for receiving the hook 3 of a clothes hanger 2.

The clip portion 30 of the unitary member 12 includes an offset plate 31 integrally joined to and perpendicularly extending from the rear wall 24 of the trough-shaped portion 20 and an insertion plate 34 downwardly extending from the offset plate 31. As such, the insertion plate 34 of the clip portion 30 is offset in spaced relation from the rear wall 24 of the trough-shaped portion 20. The offset plate 31 has a front edge 32 and a rear edge 33, and the insertion plate 34 has a top edge 35 and a bottom edge 36. Accordingly, the front edge 32 of the offset plate 31 is integrally joined to the uppermost edge 25 of the rear wall 24 and the top edge 35 of the insertion plate 34 is integrally joined to the rear edge 33 of the offset plate 31. The insertion plate 34 is of a thinness adequate for fitting between the horizontal door frame molding 4 and the adjacent wall.

In an illustrative embodiment, the front wall 21 of the trough-shaped portion 20 is about 1½ inches in height, the rear wall 24 of the trough-shaped portion 20 is about 2 inches in height, and the top edge 22 of the front wall 21 diverges from the rear wall 24 at a distance of about ¾ of an inch. In addition, the offset plate 31 of the clip portion 30 is about ¾ of an inch in width and the insertion plate 34 of the clip portion 30 is about 1¾ inches in height.

In use, the insertion plate 34 is inserted between the horizontal door frame molding 4 and the adjacent wall. Accordingly, the offset plate 31 of the clip portion 30 abuts the top of the door frame molding 4 and the rear wall 24 of the trough-shaped portion 20 is positioned adjacent the front face of the door frame molding 4. As such, a user may place the hook 3 of the clothes anger 2 over the top edge 22 of the front wall 21 of the trough-shaped portion 20. In addition, the user may place the hook 3 of the clothes hanger 2 through one of the holes 29 provided in the lip 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A clothes hanger holder for use in hanging a clothes hanger having a hook from a horizontal door frame molding, said clothes hanger holder comprising:

a unitary member including a trough-shaped portion and a clip portion extending from said trough-shaped portion, said trough-shaped portion adapted for receiving said hook of said clothes hanger and said clip portion adapted for removably securing said unitary member to said horizontal door frame molding;

wherein said trough-shaped portion includes a front wall having a top edge and a bottom edge, and a rear wall integrally joined to said front wall along said bottom edge thereof, said rear wall being generally vertically oriented and said front wall diverging from said rear wall towards said top edge thereof;

wherein said rear wall has an uppermost edge, said uppermost edge extending above said top edge of said front wall;

a pair of side walls interconnecting said front wall and said rear wall at opposite ends of said unitary member such that the hook of a said clothes hanger is adapted to be hooked on said top edge of said front wall is prevented from sliding off an end of said top edge of said front wall; and a rounded lip provided along said top edge of said front wall, said lip having a plurality of spaced holes in an upper portion of the lip, each of said holes adapted for insertion of an end of said hook of said clothes hanger to resist lateral movement of said hook along said lip.

2. The clothes hanger holder of claim 1, wherein said clip portion includes an offset plate integrally joined to and generally perpendicularly extending from said rear wall of said trough-shaped portion and an insertion plate generally downwardly extending from said offset plate.

3. The clothes hanger holder of claim 2, wherein said insertion plate is of a thinness adequate for fitting between said horizontal door frame molding and an adjacent wall.

4. The clothes hanger holder of claim 1 wherein said lip further includes a lower portion extending underneath said upper portion, said lower portion being adapted for abutting against said end of said hook of said clothes hanger when said hook is received by one of said holes.

5. The clothes hanger holder of claim 1, wherein the extent of said rear wall between a bottom edge thereof and the uppermost edge thereof is at least about twice the extent of said front wall between top and bottom edges thereof.

6. The clothes hanger holder of claim 1, wherein the lip is C-shaped.

7. A clothes hanger holder for use in hanging a clothes hanger having a hook from a horizontal door frame molding, said clothes hanger holder comprising:

a unitary member having a first end and a second end, said unitary member including a trough-shaped portion and a clip portion extending from said trough-shaped portion wherein said trough-shaped portion is adapted for receiving said hook of said clothes hanger and said clip portion is adapted for removably securing said unitary member to said horizontal door frame molding;

said trough-shaped portion including a front wall having a top edge and a bottom edge;

and a rear wall having an uppermost edge and a lowermost edge, said bottom edge of said front wall integrally joined to said lowermost edge of said rear wall, said rear wall being generally vertically oriented and said front wall diverging from said rear wall towards said top edge thereof;

said clip portion including an offset plate having a front edge and a rear edge, and an insertion plate having an insertion plate top edge and an insertion plate bottom edge, said front edge of said offset plate integrally joined to said uppermost edge of said rear wall of said trough-shaped portion, said insertion plate top edge of said insertion plate integrally joined to said rear edge of said offset plate, said offset plate being generally perpendicularly oriented to said rear wall of said trough-shaped portion and said insertion plate generally downwardly extending from said offset plate;

said insertion plate positionable in use between said horizontal door frame molding and an adjacent wall; and a rounded C-shaped lip provided along said top edge of said front wall, said lip having a plurality of spaced holes in an upper portion of the lip, each of said holes adapted for receiving said hook of said clothes hanger, said lip further having a lower portion extending underneath said upper portion, said lower portion being adapted for supporting said hook of said clothes hanger when said hook is received by one of said holes.

8. The clothes hanger holder of claim 7, wherein said uppermost edge of said rear wall extends above said top edge of said front wall.

9. The clothes hanger holder of claim 7, further comprising:

a pair of side walls, a first sidewall of said pair of side walls interconnecting said front wall and said rear wall at said first end of said unitary member and a second sidewall of said pair of side walls interconnecting said front wall and said rear wall at said second end of said unitary member.

10. The clothes hanger holder of claim 7, wherein said insertion plate is of a thinness adequate for fitting between said horizontal door frame molding and an adjacent wall.

11. A clothes hanger holder for use in hanging a clothes hanger having a hook from a horizontal door frame molding, said clothes hanger holder comprising:

a unitary member having a first end and a second end, said unitary member including a trough-shaped portion and a clip portion extending from said trough-shaped portion wherein said trough-shaped portion is adapted for receiving said hook of said clothes hanger and said clip portion is adapted for removably securing said unitary member to said horizontal door frame molding;

said trough-shaped portion including a front wall having a top edge and a bottom edge;

a rear wall having an uppermost edge and a lowermost edge, said bottom edge of said front wall integrally joined to said lowermost edge of said rear wall, said rear wall being generally vertically oriented and said front wall diverging from said rear wall towards said top edge thereof;

said clip portion including an offset plate having a front edge and a rear edge, and an insertion plate having an insertion plate top edge and an insertion plate bottom edge, said front edge of said offset plate integrally joined to said uppermost edge of said rear wall of said trough-shaped portion, said insertion plate top edge of said insertion plate integrally joined to said rear edge of said offset plate, said offset plate being generally perpendicularly oriented to said rear wall of said trough-shaped portion and said insertion plate generally downwardly extending from said offset plate;

said insertion plate positionable in use between said horizontal door frame molding and an adjacent wall;

wherein said uppermost edge of said rear wall extends above said top edge of said front wall;

a pair of side walls, a first sidewall of said pair of side walls interconnecting said front wall and said rear wall at said first end of said unitary member and a second sidewall of said pair of side walls interconnecting said front wall and said rear wall at said second end of said unitary member;

a rounded C-shaped lip provided along said top edge of said front wall, said lip having a plurality of spaced holes in an upper portion of the lip, each of said holes adapted for receiving said hook of said clothes hanger, said lip further having a lower portion extending underneath said upper portion, said lower portion being adapted for supporting said hook of said clothes hanger when said hook is received by one of said holes; and wherein said insertion plate is of a thinness adequate for fitting between said horizontal door frame molding and an adjacent wall.

* * * * *